US005910622A

United States Patent [19]

Brodmann

[11] Patent Number: 5,910,622

[45] **Date of Patent: *Jun. 8, 1999**

[54] METHOD FOR TREATING FIBROUS CELLULOSIC MATERIALS

[75] Inventor: George L. Brodmann, Port St. Lucie, Fla.

[73] Assignee: DCV, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,132

[22] Filed: Jun. 2, 1997

Related U.S. Application Data

[63] Continuation-in-part of application No. 08/738,996, Oct. 29, 1996, abandoned.

[51] Int. Cl.[6] ..... D06M 13/352; D06M 13/358

[52] U.S. Cl. ..... 8/182; 8/181; 8/183; 8/185; 8/186; 8/188; 8/189

[58] Field of Search ..... 8/181, 182, 183, 8/185, 186, 189, 196, 188, 493, 496, 537, 542, 543; 162/72, 74, 87, 157.2, 157.3, 157.6, 197

[56] References Cited

U.S. PATENT DOCUMENTS

| | | | |
|---|---|---|---|
| 3,521,995 | 7/1970 | Smith | 8/185 |
| 4,629,470 | 12/1986 | Harper, Jr. | 8/585 |

OTHER PUBLICATIONS

Trotman, Dyeing and Chemical Technology of Textile Fibers, 6th edition, pp. 331, 335, 353, and 357 (month unknown), 1984.

*Primary Examiner*—Alan Diamond

[57] ABSTRACT

Method for treating fibrous cellulosic materials using an aqueous cationic treating solution containing a cyclic polyhydroxy compound and choline chloride, by which dye uptake of the material, and the environmental effects of the subsequent dyeing process are improved.

4 Claims, 1 Drawing Sheet

METHOD FOR TREATING FIBROUS CELLULOSIC MATERIALS

CROSS REFERENCE TO RELATED APPLICATIONS

This application is a continuation-in-part of U.S. patent application Ser. No. 08/738,996, filed Oct. 29, 1996 now abandoned.

FIELD OF INVENTION

The invention is directed to a method for treating fibrous cellulosic materials, especially cellulosic fabrics made from cotton and blends of cotton with other fibers such as polyester, nylon, wool, and silk. More particularly, the invention is directed to the treatment of those materials in such manner that both the treating step and subsequent dyeing of the materials are more effective and efficient.

BACKGROUND OF THE INVENTION

Anionic dyes, such as fiber reactive dyes and direct dyes, are currently employed for dyeing cellulose fibers because of their wide shade range, ease of application, and adequate wet fastness properties for many end uses.

There are, however, certain environmental problems related to the utilization of such dyes, which occur because high amounts of electrolyte and alkalinity must be used, and the relatively poor uptake of such dyes into the cellulosic fibers. Depending on the application method, shade depth and dye type, only 70–80% of the dye becomes attached to the substrate using conventional dyeing methods. Consequently, dyehouse effluents contain an unacceptably high level of unfixed dye, electrolytes and alkaline residues which can cause environmental hazards, and compliance problems with EPA discharge standards.

The above-described problems were addressed in part by Weltrowski et al in U.S. Pat. No. 5,501,711 by mildly oxidizing the fibers, subjecting the oxidized fibers to reduction with a solution of chitosan oligomers, stabilizing the chitosan-treated fibers by addition of a reducing agent such as dimethylol dihydroxyethyleneurea (DMDHEU), and then dyeing the thusly treated fiber. This process involves 4–5 steps, and even then does not address the problems of dye fastness and the high cost of the chitin treatment. This process represents a substantial improvement in dye pickup, and therefore improved dye exhaust from the dye bath. However, the discharge of metals into dye bath effluents remains a particularly troublesome problem, because so many dyes contain substantial quantities of metals. For example, many blue dyes contain copper, and many brown dyes contain chromium. In addition, some dyes contain such metals as cobalt and magnesium. Traces of catalyst are a still further source of metallic contaminants from dye bath effluents. Furthermore, certain analogs, such as N-3-chloro-2-hydroxypropyltrimethylammonium chloride, may produce toxic amounts of epichlorohydrin when they are contained in alkaline solutions. Therefore, still further improvements are needed to improve dye uptakes, to reduce electrolyte concentrations in the dye bath, and to reduce the quantity and toxicity of the discharge from the dye bath, in each case without sacrificing the dye ability of the cellulose fiber.

SUMMARY OF THE INVENTION

Generally, the invention is directed to an improved method for treating undyed fibrous cellulosic material comprising:

A method for changing the surface properties of a fibrous cellulose-containing material comprising:

(1) applying to at least one surface of the cellulose-containing material an aqueous treating solution containing (a) a cyclic polyhydroxy compound selected from the group consisting of dimethyldihydroxy ethyleneurea, dimethylol, dimethyloldihydroxy ethylene urea, trimethylol melamine, hexamethylol melamine and mixtures thereof, (b) choline chloride and (c) crosslinking catalyst to effect at least 60% wt. Pickup of the treating solution onto the material, the concentration in the treating solution of cyclic polyhydroxy compound being 5–100 g/L, the concentration of choline chloride being 40–600 g/L and the weight ratio of cyclic polyhydroxy compound to choline chloride being 0.1–6;

(2) heating the thusly treated cellulosic material from step (1) to a temperature of 250–315 F. (121–157 C.) to effect removal of water therefrom by evaporation, so that the water content is reduced to a level no higher than 1% wt.;

(3) further heating the dried material from step (2) to a temperature of 320–400 F. (169–240 C.) for 3–180 seconds to effect crosslinking of the cyclic polyhydroxy compound with the cellulose fibers in the material; and (4) cooling the crosslinked cellulosic material.

In one aspect, the invention is directed to a method for treating undyed cellulose-containing fabrics, comprising:

(1) immersing the fabric in the above-described cationic aqueous treating solution;

(2) preheating the fabric from both sides to effect removal of bonded water therefrom by evaporation;

(3) placing the partially dried fabric from step (2) on a dryer or tenter frame to effect bi-directional tensile stress on the fabric, and heating the fabric from both sides;

(4) cooling the crosslinked fabric to a temperature no higher than 150 F. (66 C.) effect pickup of moisture from the air, until the water content of the fabric is in equilibrium with the cooling air; and (5) removing the fabric from the tenter frame either between steps (3) and (4), or after step (4).

In a second aspect, the invention is directed to a method for improving the dyeing of cellulosic fabrics by treating the fabric as described above, and coloring the thusly treated fabric with an anionic dye selected from the group consisting of acid dyes, fiber-reactive dyes, direct dyes, and mixtures thereof to effect at least 90% by weight exhaustion of the dye from the dye bath.

In a still further aspect, the above described treating process is applied to the manufacture of paper.

BRIEF DESCRIPTION OF THE DRAWING

The Drawing consists of a single FIGURE, which is a schematic representation of the method for finishing cellulose-containing fabrics in accordance with the invention.

DEFINITIONS

Figure 1:
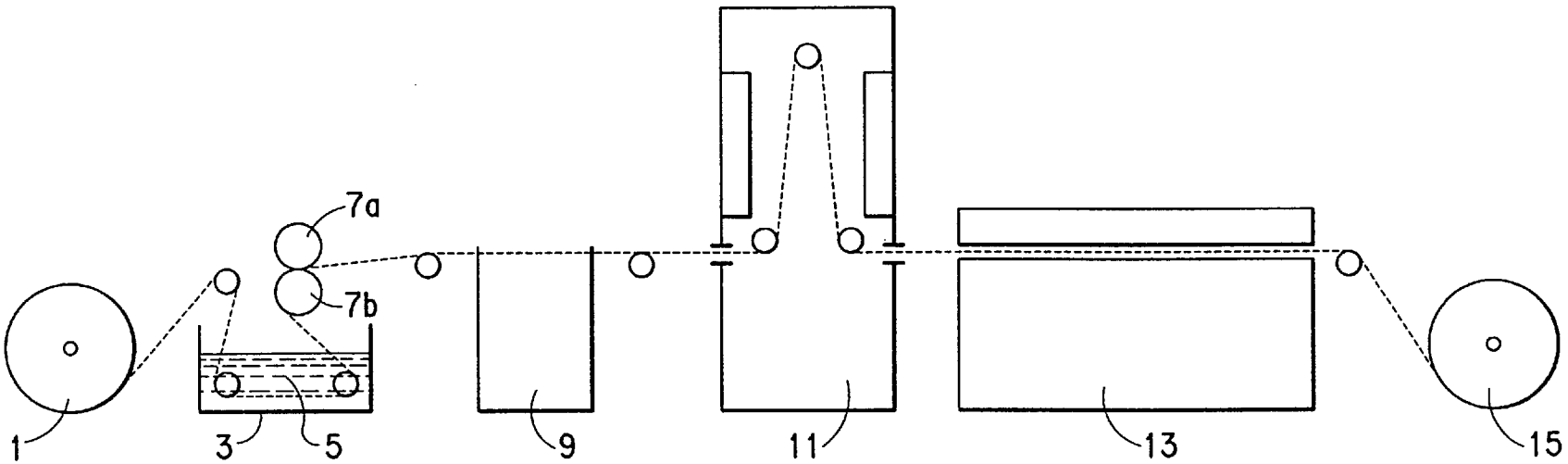

Whiteness is measured by AATCC Test method 110-1889.

The term "cellulosic fabric" refers to fabrics containing at least 25% cellulosic fibers such as cotton, and blends of cotton with polyester, wool, nylon, and rayon.

As used herein, the term DMDHEU refers to the compound dimethylol dihydroxyethyleneurea and glycolated or methoxylated analogs thereof.

"K/S" refers to the ratio of the coefficient of absorption (K) to the coefficient of scatter (S) as measured on a fabric by reflectance spectrophotometry. For a particular wavelength of light, the ratio is defined by the Kubelka-Munk function, K/S=(1−R)/2R, where R is the reflectance of a sample at the particular wavelength.

The term "dye exhaustion" refers to the % by weight of dye which has been removed from the initial amount of dye in the dye bath.

The term "owf" means "on the weight of the fiber," basis dry weight of the fiber.

The term "wet out" is a measure of the adsorbency of a fabric, and is defined as the time (in seconds) required for a drop of water placed on the surface of a fabric to disappear by adsorption into the fabric.

The expression "prepared fabric" refers to fabric which has been desized, scoured, bleached, and/or mercerized.

DETAILED DESCRIPTION OF THE INVENTION

Treating Bath Composition: The treating bath for use in the invention (the padder bath in the treatment of fabrics) is comprised of (1) a cationic reactive component, (2) cellulose crosslinking agent, and (3) catalyst for the crosslinking agent. In the treatment of fabrics, the padding bath may also contain one or more of anionic or nonionic softening agents, a wetting agent, an anti-migration agent, and a nonionic or cationic soil release agent.

It will be recognized that application of the treating composition can be carried out in several other ways. For example, in the case of fabrics, the material can be immersed in the treating solution so it can be applied by means of contact with a kiss roll or an engraved roll. Other liquid coating techniques, such as spraying, can be used as well.

For the purposes of the invention, the cationic reactive agent is choline chloride. It has been observed that the choline chloride reacts chemically with the cyclic polyhydroxy compound, but not with the fiber. In the case of DMDHEU, this reaction is believed to be as follows:

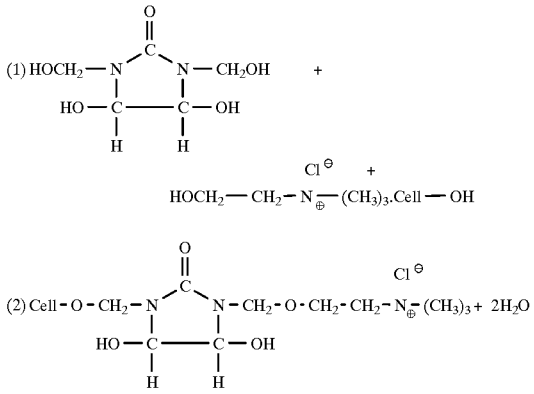

It has been observed that a nonionic dye uptake increases as more choline chloride is reacted with DMDHEU. However, in order to balance dye uptake with shrinkage control, it is preferred to use 2–4 parts by weight choline chloride per part by weight DMDHEU.

Though it is not known with certainty, the choline chloride appears to function as a lubricant or softening agent for the fiber. In addition, choline chloride is very resistant to yellowing, and therefore assists in retaining the whiteness of the treated fabric.

The cyclic polyhydroxy compound, of course, serves mainly as a crosslinking agent for the cellulose in the fibers. In that role, it is not essential to attaining high color uptake; however, its use is preferred because of its beneficial effect on reducing shrinkage of the treated fabric.

A further advantage of the invention is that various visual effects can be applied to the fabric. By varying the ratio of DMDHEU to choline chloride, the "heather" and "washdown look" can be obtained while still retaining good wash, crocking, and light fastness qualities in the fabric. For example, at a 1/6 DMDHEU/choline chloride weight ratio and a 0.5% wt. Catalyst, a 65–70% dyefill "washdown" can be obtained. On the other hand, at about 1/2 wt. ratio, the dyed fabric is color fast.

At least 5 g/L cyclic polyhydroxy compound is needed in the treating bath to obtain good shrinkage control. At least 10 g/L cyclic polyhydroxy compound is preferred. However, more than 100 g/L cyclic polyhydroxy compound is not desired, lest the tensile strength of the materials be lowered. It is interesting to note that the choline chloride mitigates the adverse effect of higher concentrations of the cyclic polyhydroxy materials. Therefore, they can be used in high amounts. For best results, the weight ratio of polyhydroxy compound to choline chloride need be only 0.1–6. It is preferred to use at least 10 g/L choline chloride in the padder bath, but no more than 300 g/L should be used in order to avoid any adverse reaction of the choline chloride with the polyhydroxy compound.

Suitable crosslinking catalysts for use in the treating bath are acid catalysts such as magnesium chloride, zinc nitrate, aluminum sulfate, and mixtures thereof.

An essential component of the padder bath is the crosslinking catalyst which brings about crosslinking of the cellulose in the fabric. At least 1 g/L of catalyst is required to crosslink adequately with the fabric, and thus to improve its fabric stability, e.g. shrinkage. However, no more than 50 g/L, and preferably no more than 40 g/L of catalyst should be used. The reason for this is that excess catalyst incurs hydrolysis of the cellulose, which results in loss of fabric tensile strength. It is interesting to note that at equivalent levels of catalyst, the intensity of color upon dyeing is enhanced by higher levels of choline chloride. This phenomenon is shown by the data in Table 4 below.

While the cyclic polyhydroxy compounds, choline chloride and catalyst are the essential components of the treating solution, other materials will need to be added to bring about particular changes in the properties of the treating bath.

For example, the migration of dye from the fibers of the fabric may occasionally also be a problem. This is, in large part, the result of low viscosity of the padding bath. Therefore, since the padding bath of the invention may not contain any significant amount of dissolved polymer, it will frequently be desirable to raise the viscosity of the padder bath by either of two procedures. The first way to increase viscosity of the bath is to reduce the water content. This can be done by applying a vacuum to the fabric emerging from the squeeze rolls on the outlet of the padding bath. The second procedure is to add a water-soluble polymer to the padding bath. It will be recognized that both methods of increasing viscosity can be used together. Suitable polymers for this purpose include poly(acrylic esters), block copolymers of mannuronic and guluronic acids.

Soil release agents are not usually needed for cotton fabrics. They will, however, be needed for high polyester/cotton blends. When they are used in the invention, suitable soil release agents include such materials as polyethyleneglycols, copolymers of methacrylic acid and ethylacrylate, and fluoroacrylic polymers. However, materials must be either nonionic or cationic in order to avoid precipitation of choline chloride.

Other additives which may be used with the invention in the padding bath include anionic or nonionic fabric softening agents and anionic or nonionic wetting agents. Suitable softening agents include nonionic fatty glycerides and polyethylene emulsions. Suitable wetting agents are nonionic detergents, such as ethoxylated linear alcohol hydrophobe-$C_{12-13}$, and the reaction product of 2,6,8-trimethyl-4-nonanol and ethylene oxide. Such materials are well known in the finishing art, and can be used with the invention in a manner similar to their use in conventional non-cationic finishing processes.

For some methods of application, it is preferred to add a fugitive tint or other ultraviolet ray absorbant to the treating solution to facilitate visual observation of the evenness with which the treating solution is applied. This is especially advisable to observe the pressure certainty of pad rolls, kiss rolls, etched rolls, etc.

In the absence of the catalyst, the primary components of the treating solution are stable and do not undergo significant reaction when the solution is stored at ambient temperatures. Thus, aqueous solutions of the cyclic polyhydroxy compounds and choline chloride can be prepared in advance for later use. Such premixed compositions are comprised of (a) cyclic polyhydroxy compounds, (b) choline chloride and the remainder (c) water. The weight ratio of (a) to (b) should be within the range of 0.1–6, which corresponds to the useful proportions of these components in the treating bath. However, the concentration of those active components in the solution can vary widely. Though small solution concentrations can be used, more concentrated solutions are more economical. Thus, it is preferred that the active components be at least 40% by weight and preferably 60% by weight or even higher. However, to avoid viscosity problems during treatment of the cellulose, it is preferred that the concentration of active components not exceed about 80%.

Finishing Operating Variables

In the finishing operation, the fabric must have a wet pickup of 50–75% weight. Drying is carried out at 250–385 F. (121–196 C.), and curing is carried out at 250–400 F. (121–204 C.). In this process, the fabric will typically pick up 3–8%, basis dry weight, of the finishing chemicals.

The curing time and temperature used in the procedure of the invention will, of course, vary in accordance with the physical properties of the fabric. Thus, they will be different for different fiber blends. On the whole, higher curing temperatures will require shorter curing times. However, some fabric blends are more sensitive to thermal degradation. For example, the curing temperature of wool blends should be kept well below 350 F. (177 C.), preferably below 330 F. (166 C.), in order to avoid damage to the woolen fibers. A temperature of about 325 F. (163 C.) is still further preferred.

It is preferred in the practice of the invention to remove substantially all of the water before curing the fabric. Therefore, it is preferred to dry the fabric at a lower temperature in order that premature crosslinking, which would impeded water removal, does not take place. Thus, during drying, the temperature should not exceed 320 F. (160 C.), and preferably no higher than 300 F. (149 C.). However, during the crosslinking step, the temperature can be raised to as high as 400 F. (204 C.), provided the curing temperature does not exceed the thermal degradation temperature of any blended fiber contained in the fabric.

As mentioned above, the drying and curing steps are a function of both time and temperature. The higher the temperature, a shorter time is needed for drying and curing. For example, during curing of the padded fabric, if a temperature of 320 F. (160 C.) is used, then the curing time should be about 2 minutes to cure the fabric completely. On the other hand, if a temperature of 400 F. (204 C.) is used, only 3 or 4 seconds is needed.

It will be recognized by those skilled in the art that it is necessary to heat set polyester/cotton fabric blends. This function can, of course, be carried out after mercerization, before padding or before dyeing. However, an advantage of the invention is that the heat setting is carried out fully in the curing step of the process. Thus, neither additional steps, nor additional equipment are required to achieve the heat setting of such synthetic fiber/cotton fabric blends.

When the fabric being treated by the process of the invention is to undergo dyeing, it is essential that the fabric be prepared in order to avoid interference with the uptake of the dye into the fabric.

Dye Bath Composition

An important feature of the padding step of the invention is that it does not require any particular operational changes in the subsequent dye bath. Thus, the fabric/liquor ratio (F/L) will usually be within the range of 1:5– 1:40, and conventional dye bath temperatures will be used, for example, 60 C. to 115 C. (140–239 F.). All anionic dyes can be used in dyeing fabrics which have been prepared in accordance with the invention. However, the dyes listed in Table 1 are preferred.

TABLE 1

SELECTED ANIONIC DYESTUFFS FOR CATIONIC FINISHING (5 is Best)

| Dye Type | Dyestuff | % Dye Depth Over Regular Dye | II A Wash | Wet/Dry Crocking | Light fastness 20 hrs/ 40 hrs |
|---|---|---|---|---|---|
| Acid | Acidol B. Yellow M-5GL | | 4 | 4/5 | 5/5 |
| | Acidol Yellow M-5RL | | 5 | 4/5 | 5/5 |
| | Acidol Yellow M-2GLN | | 5 | 4/5 | 5/5 |
| | Acidol Orange M-RL | | 5 | 4/5 | 5/5 |
| | Acidol Scarlet M-L | | 5 | 3/4 | 5/5 |
| | Acidol B. Blue M-5G | | 5 | 3/4 | 5/5 |
| | Acidol Dark Blue M-TR | | 5 | 3/4 | 5/5 |
| | Acidol Green M-FGL | | 5 | 3/4 | 5/5 |
| | Acidol Brown KM-N | | 5 | 3/4 | 5/5 |
| | Acidol Black M-SRL | | 5 | 5/4 | 5/5 |
| | Palantin Fast Yellow GRN 200% | | 5 | 3/4 | 5/5 |
| | Palantin Fast Pink BNT | | 5 | 3/4 | 5/5 |
| Reactive | Basilen Yellow F3RM | 90% | 5 | 4/5 | 4/4 |
| | Basilen Yellow E-3G | 30% | 5 | 5 | 4/4 |
| | Basilen Red FRM | 170% | 5 | 5 | 5/4 |
| | Basilen Red F-3BM | 80% | 5 | 5 | 5/4 |
| | Basilen Blue E-BGF | 80% | 5 | 5 | 3/2 |
| | Basilen Blue E-RFN | 10% | 5 | 5 | 3/2 |
| | Basilen Blue FKN | 30% | 5 | 5 | 5/4 |
| | Basilen Brown E-RA | 70% | 5 | 5 | 3/2 |
| | Basilen Golden Yellow E-2R | 20% | 5 | 5 | 5/2 |
| | Cibracron Yellow LS-R | 15% | 5 | 4/5 | 5/5 |

TABLE 1-continued

SELECTED ANIONIC DYESTUFFS FOR CATIONIC FINISHING (5 is Best)

| Dye Type | Dyestuff | % Dye Depth Over Regular Dye | II A Wash | Wet/Dry Crocking | Light fastness 20 hrs/ 40 hrs |
|---|---|---|---|---|---|
| | Cibacron Scarlet LS-2G | 50% | 5 | 4/5 | 5/5 |
| | Cibacron Orange LS-BR | 40% | 5 | 4/5 | 5/4 |
| | Cibacron Red LS-B | 50% | 5 | 5/3 | 5/4 |
| | Cibacron Blue CR | 10% | 5 | 4/5 | 4/3 |
| | Cibacron Blue LS-3R | 40% | 5 | 3/4 | 5/4 |
| Reactive | Sumafix Yellow 4GL | 40% | 5 | 5/4 | 5/5 |
| | Remazol Red 3BS | 50% | 5 | 5/4 | 4/3 |
| | Sumafix Blue R | 80% | 5 | 5/4 | 5/4 |
| | Remazol B. Violet 5R | 70% | 5 | 5/4 | 4/3 |
| Direct | Superlight Fast Blue RL | 80% | 4 | 5/4 | 5/5 |
| | Superlight Fast Rubine WLKS | 150% | 3 | 3/4 | 5/5 |
| | Superlight Orange EGLL | 80% | 4 | 5/4 | 5/5 |
| | Superlight Fast Yellow EFC | 30% | 4 | 5/4 | 5/5 |
| | Intralight B. Blue L | 40% | 4 | 4/5 | 5/5 |
| | Intralight Fast Blue NBLL | 40% | 4 | 5/4 | 5/5 |
| | Intralight Fast Blue FGL | 43% | 4 | 4/5 | 5/5 |

In the above Table 1, the dyes and their sources are identified by the following registered trademarks:

| Trademark | Proprietor |
|---|---|
| Acidol | Badische Anilin & Soda Fabrik A.G. (BASF) Ludwigshafen/Rhine, FRG |
| Basilen | BASF |
| Cibacron | Ciba-Geigy Corporation New York, NY |
| Intralight | Crompton & Knowles Corporation New York, NY |
| Palantin | BASF |
| Remazol | Hoechst, A.G. Frankfurt/Main, FRG |
| Sumafix | Mitsubishi K.K., Tokyo, Japan |
| Superlight | Crompton & Knowles Corporation |

In addition to the dyes discussed above, sulfur, vat and azoic dyestuffs can be used for the coloration of fabrics which have been treated in accordance with the invention. Sulfur and vat dyes are anionic in their leuko form and the azoic dyes are anionic due to the presence of sulfonic salt groups in the molecule.

Dye Bath Operating Variables

The dye bath in which the prepared fabric is colored will usually contain water, dye, leveling agent, wetting agent, and defoamer.

For use with anionic dyestuffs, such as those used in this invention, the wetting agents must be nonionic or anionic. Polyethylene glycol (mono-octylphenyl) ether is useful for this purpose.

In the course of agitation, such as that which is encountered in jet dyeing, a microfoam may be produced. Such foaming can be eliminated by addition to the dye bath of a small amount of nonionic defoaming agent, such as 0.1–0.2% wt. silicone polymer.

To moderate the dye exhaustion rate, it will frequently be desired to add to the dye bath a small amount of a leveling agent. These materials form an intermediate complex with the dyestuff which facilitates migration of unfixed dyestuff to less concentrated areas.

While the proportions of these essential components will vary widely according to the fabric, the exact nature of the finishing treatment and the dye composition, they will normally be present in the following proportions, owf:

| | |
|---|---|
| Dye | 0.1–4% |
| Leveling Agent | 1–3% |
| Wetting Agent | 0.1–1.0% |
| Defoamer | 0.1–0.3% |

A still further critical operating variable in the dye bath is the fabric/liquor weight ratio, which will usually be within range of 1:5 to 1:40. Dye bath temperatures will be at least 150 F. (66 C.), and preferably 200–205 F. (93–96 C.). The time within the dye bath will usually be a function of the degree of dye uptake which is desired. It is, of course, a major advantage of the invention that the time required to attain high dye exhaust levels is greatly reduced.

Referring now to FIG. 1, the treatment of cellulosic fabrics in accordance with the invention will ordinarily be carried out in the following continuous manner:

The previously prepared (desized, bleached and mercerized) fabric to be pretreated is provided on fabric feed roll 1 from which it is drawn to padder 3, comprising a trough and two squeeze rolls. The padder 3 contains a bath of cationic treating solution 5, through which the fabric is passed, and adsorbs a quantity of treating solution. Emerging from the treating bath, the fabric is passed between squeeze rolls 7*a* and 7*b* to removed excess treating solution from the fabric. The fabric, containing both unbonded and adsorbed treating solution, is passed from the squeeze rolls 7*a* and 7*b* to vacuum slot extractor 9, in which the fabric is subjected to the force of a vacuum from below to remove unbonded treating solution contained in the fabric. The fabric leaving the vacuum slot extractor 9 contains about 50% owf treating solution. From vacuum slot extractor 9, the fabric is passed to infra-red drier 11, in which the fabric is heated vertically on both sides to a temperature of at least 250 F. (121 C.) to effect removal of unbonded water down to a level of 5–20% owf. Temperatures as high as 315 F. (157 C.) are frequently used for this purpose. It is, of course, necessary to retain at least 5% weight moisture in the fabric in order to maintain an adequate degree of fiber swelling, which is needed to control uniformity and width of the fabric. It is preferred, however, that the fabric entering the tenter contain no more than about 20% weight water in order to make the process more efficient. A moisture level of 10–15% is preferred. It is noted that the most desirable moisture content for the fabric will vary according to the kind of a fabric being treated, and the extent of the pretreatment. The heated fabric is removed from the infra-red drier 11 and passed to enclosed tenter 13, in which the fabric is placed on tenter hooks to apply to the fabric a bi-directional tensile stress. The thusly supported fabric is then subjected to heating on both sides of the fabric by heated air, and the temperature of the fabric is raised to a level of 250–400 F. (121–204 C.). The speed of the fabric through the tenter 13 at about 350–400 F. (177–204 C.) is about 50–75 yards/min. (45.7–68.6 m/min.). It is necessary to cool down the fabric as it leaves the tenter and before it is rolled up in order to minimize further chemical reactions in the fabric while it is rolled. Therefore, at the downstream end of the tenter, the fabric is air cooled to about room temperature, and the fabric is wound on fabric storage roll 15 before subsequent dyeing. Upon leaving the cooling section of the tenter, the water content of the fabric is in approximate equilibrium with the cooling air, e.g. about 8–10% weight.

It will be recognized that the treating solution can be applied to the fabric by techniques other than padding, such as roll coating, using either engraved rolls or kiss rolls. The treating solution can be applied to one or both sides of the fabric by the use of one or two rolls respectively.

When the treating solution is applied by padding (by immersion) the capacity of the treating solution will usually be higher than when it is applied by roll coating. Thus the concentration of the ingredients of the treating solution are higher for padding applications.

An important variable in the padding and dyeing of fabrics is the effect of the padding bath on the whiteness of the fabric. The fabric being prepared by the invention is preferred to have a whiteness of at least 60 in order to assure consistent color. An important advantage of the invention is that it has no detrimental effect on the whiteness of the treated fabric. In fact, the use of choline chloride in the padding step appears to reduce the yellowing caused by other components of the padding bath. Catalysts and polymers are frequently troublesome in this regard. Therefore, when desired, the whiteness of the fabric can be retained at a level of 80–90 by merely adjusting the residence time and temperature of the fabric within the tenter. In particular, by lowering the temperature and/or residence time within the tenter, the degree of whiteness can be retained at such higher levels.

The invention is, of course, useful for treating woven, non-woven and knitted fabrics and goods made therefrom, as well as thread and yarn for use in making fabrics. In addition, the invention can be used for the treatment of other substrates containing cellulosic fibers, such as wood pulp, and paper.

When the invention is applied to the treatment of paper, it can be carried out in any of three different places in the paper manufacturing process. That is, the treating solution can be added to the process before sheet formation at either the beater or the head box. However, the treating solution can also be applied to the paper after sheet formation in a manner analogous to the treatment of fabrics as described above.

EXAMPLES

Example 1

A prepared 100% cotton fabric was pretreated at room temperature with a cationic treating solution having the composition given below. In addition, a like amount of the same fabric was pretreated in the same manner, except that choline chloride was omitted from the composition for purposes of comparison:

| | |
|---|---|
| DMDHEU (70% aq. soln.) | 40 g/L |
| Choline Chloride (70% aq. soln.) | 100 g/L |
| $MgCl_2$ Catalyst (25% aq. soln.) | 40 g/L |
| Softener (25% aq. soln.) | 10 g/L |
| Non-ionic wetting agent (100%) | 0.5 g/L |

Pickup of the treating solution by the fabric was 70% owf, after which the treated fabric was dried at 250 F. (121 C.) for two minutes, and then cured at 375 F. (191 C.) for one minute.

Example 2

Separate quantities of the pretreated fabrics from Example 1 were then dyed with Solophenyl Blue 10 GL, a direct dye, and Cibacron Blue CR, a fiber-reactive dye, to observe the dye exhaustion from their respective dye baths. The fabric was jet dyed at 1:20 fabric-to-liquor ratio, both the fiber-reactive and direct dyestuffs were used in the bath at a 3% owf level. For direct dyeing of the unfinished fabric, the dyebath contained 180 g/L common salt and, for the fiber-reactive dyes, the dyebath contained 4 g/L soda ash, 100 g/L common salt, and 1 g/L NaOH. For dyeing of the prefinished fabric, no chemicals were needed and therefore were not added. The dyeing results are given in Table 2, which follows:

TABLE 2

DYE EXHAUSTION STUDY

| Direct Dye, Solophenyl Blue 10 GL | | | | Fiber Reactive Cibacron Blue CR | | | |
|---|---|---|---|---|---|---|---|
| 100% Cotton | | 100% Cotton Cationic Prefinished | | 100% Cotton | | 100% Cotton Cationic Prefinished | |
| Time | % Dye Exhaustion | Time | % Dye Exhaustion | Time | % Dye Exhaustion | Time | % Dye Exhaustion |
| 0 | 0 | 0 | 0 | 0 | 0 | 0 | 0 |
| 15 | 20 | 15 | 20–25 | 15 | 15 | | 10 |
| 30 | 40 | 30 | 40–44 | 30 | 25 | | 15 |
| 60 | 60 | 60 | 60–63 | 60 | 30 | | 25 |
| 75 | | 75 | 80–82 | 75 | 40 | | 35 |
| 90 | 65 | 90 | 97–100 | 90 | 45 | | 55 |
| 105 | 70–72 | | | 105 | 50 | | 70 |
| 120 | 75–76 | | | 120 | 55 | | 80 |
| 135 | 80–83 | | | 135 | 60 | | 82 |
| 150 | 85–86 | | | 150 | 65 | | 85–90 |
| 175 | 87–90 | | | 175 | 75 | | |
| 200 | | | | 200 | 78 | | |
| 215 | | | | 215 | 80 | | |
| 230 | | | | 230 | 82 | | |
| 245 | | | | 245 | 85–90 | | |

The data in Table 2 show that 90% dye uptake for the cationically prefinished fabrics required only 90 minutes, whereas the time to achieve 90% dye uptake for the untreated fabric was 175 minutes for the direct dye, and 245 minutes for the fiber-reactive dye. Though only nominally, 90% dye uptake was achieved by the fabrics, which had not been pretreated in accordance with the invention, substantially complete (100%) uptake was achieved for those fabrics which had been pretreated in the manner of the invention.

Example 3

Using the same cationic treating procedure as described in Example 1, a series of pre finishing tests was carried out in which the relative proportions of choline chloride, DMDHEU and catalyst were varied to determine the relative effectiveness of such solutions. The tests were carried out at chemical add-on levels of 6 and 8% owf. Fabric shrinkage after home laundry washing, tensile strength and tear strength were measured on each fabric sample. The results are given in Table 3 below:

TABLE 3

EFFECT OF CHOLINE CHLORIDE AND DMDHEU RATIO AND ADD-ON FABRIC DIMENSIONAL STABILITY (LAUNDRY SHRINKING), PHYSICAL PROPERTIES

Application: Pad Chemicals - Squeeze - Dry - Cure 380° F., 60 seconds

| | Ratio | | | | Fabric Physical Properties | | | |
|---|---|---|---|---|---|---|---|---|
| | Choline CI | DMDHEU | Catalyst | Add-on | Home Laundry Washing, % Shrinkage | | Tensile Strength, | Tear Strength, |
| | 70%** | 70%** | 25%** | % OWF | After 15 | After 30 | lbs. | lbs. |
| 1 | 1 | 1 | .2 | 6 | 4.0 | 4.5 | 15 | 10.0 |
| 2 | 2 | 1 | .2 | 6 | 3.0 | 3.5 | 23 | 15.0 |
| 3 | 1 | 2 | .2 | 6 | 2.0 | 2.5 | 19 | 16.0 |
| 4 | 1 | 1 | .3 | 6 | 4.0 | 4.0 | 12 | 9.0 |
| 5 | 2 | 1 | .3 | 6 | 2.5 | 3.0 | 15 | 14.0 |
| 6 | 1 | 2 | .3 | 6 | 2.0 | 2.5 | 17 | 12.0 |
| 7 | 1 | 1 | .2 | 8 | 4.0 | 4.0 | 10 | 8.5 |
| 8 | 2 | 1 | .2 | 8 | 2.0 | 2.0 | 13 | 13.0 |
| 9 | 1 | 2 | .2 | 8 | 2.0 | 2.0 | 18 | 12.0 |
| 10 | 1 | 1 | .3 | 8 | 3.5 | 4.0 | 15 | 9.0 |
| 11 | 2 | 1 | .3 | 8 | 2.0 | 2.5 | 20 | 14.0 |
| 12 | 1 | 2 | .3 | 8 | 4.5 | 5.0 | 12 | 16.0 |
| Durable Press Finishing Treatment | | 100 | .3 | 6 | 2.5 | 3.0 | 19 | 14.0 |

*Samples 2 and 11 had best dye uptake and color fastness.
Tensile and Tear: The higher the number, the better the retained fabric strength
**Wt. concentration in water.

By comparison of Examples 1 and 2, 4 and 5, 7 and 8, and 10 and 11, it is seen increasing the amount of choline chloride in every case resulted in decreased amount of fabric shrinkage, and both the tensile strength and tear strength were improved. This was true at both 6% and 8% add-on. These data do show that the use of higher amounts of catalyst causes at least minor detriment to shrinkage, tensile and tear strength. For example, compare test numbers 8 and 11 and test numbers 9 and 12. For purposes of comparison, it should be noted that acceptable levels of tensile strength and tear strength are 14 lbs. and 19 lbs, respectively.

Dye uptake and color fastness of all the above examples were satisfactory, but Samples 2 and 11 had the best dye uptake and color fastness.

Example 4

Using the same procedure as in the previous examples, a series of tests was carried out to observe the effect on Maximum dye yield of the ratio of choline chloride, DMDHEU and catalyst level. The results of these tests are given in Table 4 below.

TABLE 4

CORRELATION OF DYE YIELD WITH THE RATIOS OF CHOLINE CHLORIDE, DMDHEU, AND CATALYST LEVEL

Test Results Based on K/S Colorimetric Test on cationic and jet dyed (3%) 100% cotton fabric

| Wt. Ratio of CC*/DMDHEU/ | Acid | | Reactive | | Direct | |
|---|---|---|---|---|---|---|
| Catalyst | pH6 | pH3 | pH6 | pH3 | pH6 | pH3 |
| 50/0/0 | 0.09 | 0.12 | 0.12 | 0.12 | 3.23 | 2.78 |
| 100/0/0 | 0.11 | 0.14 | 0.24 | 0.25 | 5.02 | 3.35 |
| 100/0/15 | 0.13 | 0.15 | 0.29 | 0.29 | 4.69 | 3.30 |
| 100/0/30 | 0.29 | 0.22 | 0.48 | 0.39 | 5.86 | 3.82 |
| 50/100/15 | 0.90 | 0.96 | 2.27 | 2.04 | 10.68 | 10.54 |

TABLE 4-continued

CORRELATION OF DYE YIELD WITH THE RATIOS OF CHOLINE CHLORIDE, DMDHEU, AND CATALYST LEVEL

Test Results Based on K/S Colorimetric Test on cationic and jet dyed (3%) 100% cotton fabric

| Wt. Ratio of CC*/DMDHEU/ | Acid | | Reactive | | Direct | |
|---|---|---|---|---|---|---|
| Catalyst | pH6 | pH3 | pH6 | pH3 | pH6 | pH3 |
| 50/100/30 | 1.07 | 0.99 | 2.34 | 1.96 | 10.65 | 9.38 |
| 100/100/15 | 1.96 | 1.05 | 4.90 | 1.43 | 15.09 | 14.31 |
| 100/100/30 | 1.71 | 0.87 | 6.98 | 6.21 | 17.74 | 14.74 |
| 150/100/30 | 2.46 | 0.90 | 7.85 | 6.70 | 18.19 | 15.60 |
| 150/100/40 | 3.56 | 1.20 | 8.87 | 7.40 | 20.15 | 17.34 |

Percent chemical add-on 6% owf.
K/S = higher the number more dye yield
*CC = Choline Chloride The K/S values in the above table indicate the higher dye uptakes which are available from the invention. For example, the use of choline chloride alone gave very low K/S values, and the use of catalyst in addition to the choline chloride gave some improvement. However, when DMDHEU was also added, the K/S values were many times higher.

Example 5

A further series of tests was carried out to observe the effect of drying and curing conditions (time and temperature) on dye yield. The proportions of the treating solution were 150/100/40 choline chloride/DMDHEU/Catalyst. The measurements were made on cationic prefinished 100% cotton fabric having 6% owf dye uptake. Dye yield was measured by the K/S value, i.e. total wavelength/average wavelength, of each specimen. These data are given in Table 5 below:

TABLE 5

EFFECT OF DRYING AND CURING ON DYE YIELD

| Drying and Curing Conditions | Dyestuffs (3%) Cibacron Blue CR (1) | Remazol Blue R (1) | Solophenyl Blue 10GL (2) |
|---|---|---|---|
| Dried and Cured at 350F (177C), 1 minute | 0.53 | 0.14 | 2.53 |
| Dried & Cured 350F (177C), 2 minutes | 17.50 | 11.28 | 24.01 |
| Dried at 280F (138C), 2 minutes Cured at 350F (177C), 1 minute | 20.56 | 9.48 | 17.50 |
| Dried at 280F (138C), 2 minutes Cured at 380F (193C), 1 minute | 24.01 | 14.89 | 24.56 |

*Percent add-on 6% owf.
K/S = higher number, darker the color

These data show that, by varying the temperatures, the drying and curing steps can be carried out satisfactorily in either a single step or two steps. In particular, the data show that a temperature of 350 F. (177 C.) for 1 minute was insufficient to get satisfactory dye uptake, but when the time was raised from 1 minute to 2 minutes, dye uptake as indicated by K/S values rose to a usable level. However, the use of two steps, that is the use of different temperatures for drying and curing, yielded significantly higher K/S values. Maximum K/S values were obtained when drying was carried out at 280 F. (138 C.) for 2 minutes, and curing was carried out at 380 F. (193 C.) for 1 minute.

Example 6

A large-scale commercial cationic prefinishing and dyeing trial was carried out, using 200 yards each of 3/1 twill, 100% cotton, and Oxford cloth, 100% cotton. The dyeing was conducted in a commercial scale jet dryer, using various combinations of two or three different dyes.

The subject fabrics were padded at 30 psi pressure at a speed of 25 yards per minute using a two-roll squeeze roll. Liquid pickup was about 70–75% on a wet basis. The padded fabrics were dried at 280–290 F. (138–143 C.) for 140 seconds on a tenter frame set at a width of 69 inches (175 mm). The dried fabric was cured on the same tenter frame at 365 F (185 C.) for 35–40 seconds. The prefinished fabric was then dyed on Gaston County jet dyeing equipment at a fabric/liquor ratio of 1:25. From 4–5 Kg of both fabrics were dyed with various, dye combinations to assess the dyeing uniformity of the fabrics, shade development and color fastness. The composition of the padding bath was as follows:

| | |
|---|---|
| 120 g/L | Choline chloride (70%) |
| 60 g/L | Fixapret ECO (70%) |
| 30 g/L | Catalyst HC |
| 1 g/L | Siligen NB 250 (softener) |
| 1 g/L | Basapon LN (wetting agent) |
| Remainder | Water |
| Total 1000 g | |

The dye compositions are given in Table 6 below:

TABLE 6

DYESTUFF COMBINATIONS

| No. | Amount | Dye Composition | Dye Type |
|---|---|---|---|
| 1 | 1.8% | Basilen Blue F-KM | Reactive |
| | 0.1% | Basilen Yellow E-36 | Reactive |
| | 0.1% | Basilen Red F-3BN | Reactive |
| 2 | 1.6% | Acidol B Blue H-59 | Acid |
| | 0.4% | Acidol B Yellow H-59L | Acid |
| 3 | 1.9% | Solophenyl Black FG-250 | Direct |
| | 0.1% | Solophenyl Blue 10 GL | Direct |
| 4 | 1.7% | Cibacron Red C-29 | Reactive |
| | 0.3% | Cibracron Yellow C-R | Reactive |
| 5 | 1.0% | Cibacron Red C-29 | Reactive |
| | 1.0% | Basilen Red F-3 BM | Reactive |
| 6 | 1.9% | Acidol Dark Blue M-TR | Acid |
| | 0.1% | Acidol Orange H-SR | Acid |

All of the fabric dyeings had good appearance for commercial acceptance with excellent wash, crocking (rubbing), and light fastness. The results are given in Table 7 below:

TABLE 7

COLOR FASTNESS OF TEST FABRICS

| Test No. | Wash (1) | Crocking (2) Wet | Crocking (2) Dry | Light fastness 20 hours | Light fastness 40 hours |
|---|---|---|---|---|---|
| 1 | 5 | 5 | 5 | 4 | 3 |
| 2 | 5 | 4 | 5 | 5 | 3 |
| 3 | 4 | 5 | 5 | 4 | 3 |
| 4 | 5 | 5 | 5 | 5 | 3 |
| 5 | 5 | 5 | 5 | 4 | 3 |
| 6 | 5 | 4 | 5 | 4 | 3 |

In the foregoing data, a score of 5 is best. A score of 3 is a commercially acceptable minimum. All scores are based on the AATCC scale, which is based on the Grey Scale.
(1) 120F, 45 minutes with detergent only. This test is a measure of color bleeding or color loss;
(2) This test is a measure of rubbing resistance, that is, loss of color due to dye loss from abrasion.

What is claimed is:

1. A method for improving the surface properties of cellulose-containing paper comprising:

(1) applying to at least one surface of the cellulose-containing paper a cationic aqueous treating solution containing (a) a heterocyclic polyhydroxy compound selected from the group consisting of dimethyldihydroxy ethyleneurea, dimethyloldihydroxy ethyleneurea, trimethylol melamine, hexamethylol melamine and mixtures thereof, (b) choline chloride and (c) crosslinking catalyst to effect at least 60% wt. pickup of the treating solution onto the material, the concentration in the treating solution of heterocyclic polyhydroxy compound being 5–100 g/L, the concentration of choline chloride being 40–600 g/L and the weight ratio of heterocyclic polyhydroxy compound to choline chloride being 0.1–6;

(2) heating the thusly treated paper from step (1) to a temperature of 250–315 F. (121–157 C.) to effect removal of water therefrom by evaporation, so that the water content is reduced to a level no higher than 1% wt.;

(3) further heating the dried paper from step (2) to a temperature of 320–400 F. (169–240 C.) for 3–180 seconds to effect crosslinking of the cyclic polyhydroxy compound with the cellulose fibers in the paper; and (4) cooling the crosslinked cellulosic paper.

2. The method of claim 1 in which the treating solution is applied by addition of the cationic aqueous treating solution to a beater box before formation of sheet paper.

3. The method of claim 1 in which the treating solution is applied by addition of the cationic aqueous treating solution to a head box before formation of sheet paper.

4. The method of claim 1 in which the treating solution is applied after formation of sheet paper.

* * * * *